United States Patent [19]

Shelton et al.

[11] Patent Number: 4,726,586

[45] Date of Patent: Feb. 23, 1988

[54] POOL BALL RETURN CONTROL APPARATUS

[75] Inventors: Richard B. Shelton, Bay City; Bruce D. Allen, Saginaw, both of Mich.

[73] Assignee: Kidde Recreation Products, Inc., Bay City, Mich.

[21] Appl. No.: 699,355

[22] Filed: Feb. 7, 1985

[51] Int. Cl.[4] ..... A63D 15/00

[52] U.S. Cl. ..... 273/11 C; 273/125 A

[58] Field of Search ..... 273/10, 11 R, 11 C, 273/14, 121 A, 122 A, 123 A, 124 A, 125 A, 121 D, 29 A

[56] References Cited

U.S. PATENT DOCUMENTS

| | | | |
|---|---|---|---|
| 1,227,833 | 5/1917 | Russell | 273/11 R |
| 2,084,452 | 6/1937 | Radtke | 273/121 A |
| 2,358,533 | 9/1944 | Orihuela | 273/11 C |
| 2,756,998 | 7/1956 | Fisher | 273/11 R |
| 3,304,085 | 2/1967 | Heiss et al. | 273/11 C |
| 3,362,710 | 1/1968 | Feddick et al. | 273/11 C |
| 3,424,456 | 1/1969 | Daddis | 273/11 C |
| 3,466,036 | 9/1969 | Connelly et al. | 273/11 C |
| 3,618,943 | 11/1971 | Milu | 273/11 C |
| 3,967,821 | 7/1976 | Bagley | 273/11 C |
| 4,116,435 | 9/1978 | Sines et al. | 273/11 R |
| 4,193,596 | 3/1980 | Baker | 273/11 C |
| 4,233,953 | 11/1980 | Bash | 273/29 A |
| 4,388,074 | 9/1981 | Kainz | 273/29 A |

*Primary Examiner*—Richard C. Pinkham
*Assistant Examiner*—T. Brown
*Attorney, Agent, or Firm*—Learman & McCulloch

[57] ABSTRACT

A pool table having a playing surface with which ball accommodating pockets are associated. Pocketed balls are conveyed by a runway system via a trap toward a compartment at one end of the table that is accessible to a player. The trap has a gate magnetically latched in closed position so as to prevent passage of the object balls into the compartment until such time as a coin control mechanism is operated to effect unlatching and opening of the gate. The gate is maintained in its open position for a sufficient period of time to permit the passage of all the object balls from the trap to the compartment. Following movement of the last object ball past the gate the latter returns automatically to its closed, latched position.

19 Claims, 8 Drawing Figures

POOL BALL RETURN CONTROL APPARATUS

This invention relates to control apparatus for a pool table having ball-receiving pockets in communication with a compartment to which pocketed balls are delivered for retrieval, and more particularly to control apparatus which precludes pocketed object balls being retrieved until such time as one or more coins are deposited in an operating mechanism.

BACKGROUND OF THE INVENTION

Coin controlled pool tables are in wide usage and each such table conventionally has a playing surface adjacent which are several pockets for the accommodation of balls. Each such pocket has associated therewith a runway leading to a trough which, in turn, leads to a compartment from which pocketed balls may be retrieved. It is conventional to prevent retrieval of pocketed object balls until such time as one or more coins are deposited in a control mechanism which is operable to effect access to such balls.

Most pool tables having a coin controlled mechanism for enabling and disabling access to pocketed object balls also are provided with means enabling retrieval of the cue ball independently of the object balls whenever the cue ball is pocketed. There basically are two systems currently in use which enable pocketed cue ball retrieval. In one system the cue ball has a diameter larger than that of the object balls and the table includes means engageable by the larger size cue ball to divert it from the path leading to the object ball storage compartment and direct it to another path leading to an accessible cue ball compartment. The second system utilizes a magnetically permeable cue ball which is acted upon by a magnet so as to divert the cue ball from the path leading to the object ball storage compartment and direct it along another path leading to an accessible compartment.

The mechanisms currently in use for limiting access to pocketed object balls and separating the cue and object balls perform their intended functions satisfactorily, but have some disadvantages. For example, most of the control mechanisms currently in use are composed of complex linkage assemblies which are expensive to manufacture and assemble and require frequent maintenance. Because of the complexity of such mechanisms proper maintenance requires skilled personnel and usually takes considerable time. In many instances, maintenance or repair of the control mechanism necessitates removal of the pool table from service for an inordinate period of time.

Apparatus constructed in accordance with the disclosed embodiment of the invention comprises a coin operated ball control mechanism which is greatly simplified compared to known constructions for similar purposes, thereby substantially minimizing manufacturing and maintenance costs. Further, apparatus constructed in accordance with the invention requires little maintenance and that which is required often can be performed quickly and by relatively unskilled personnel.

SUMMARY OF THE INVENTION

Apparatus constructed in accordance with the invention is adapted for use in conjunction with a pool table having a playing surface adjacent which ball accommodating pockets are associated. Each pocket communicates with a runway which, in turn, communicates with a trough by means of which all pocketed balls are delivered by gravity to a pathway leading to a ball retrieval compartment. Interposed between the common trough and the retrieval compartment is a trap having a barrier or gate which normally occupies a position preventing passage of pocketed balls to the compartment. The gate is magnetically latched in its normal position, but is pivoted for swinging movement to a position in which the pocketed balls may pass from the trap into the compartment. Movement of the gate to such position as to enable passage of the balls to the compartment is effected by a rockable crank which, in response to rocking movement in one direction, overcomes the magnetic latching force applied on the gate and opens the latter, thereby enabling movement of the balls from the trap to the retrieval compartment. Movement of the crank is effected by an actuator slide forming part of a conventional coin control mechanism.

The magnetic force under which the gate normally is latched in its closed position is such as to maintain the gate closed regardless of the number of balls which may occupy the trap. However, once the gate has been swung to its open position, the force of the magnet is insufficient to effect closing of the gate, thereby enabling the gate to remain open until all of the balls have passed it. Further, the gate is so mounted as constantly to be biased toward its closed position. Thus, once all of the pocketed balls have moved past the gate, the gate will close and balls pocketed thereafter will be unable to pass the gate until the latter again is opened by operation of the coin controlled actuator.

The gate operating means carries a stop finger which, when the gate initially is moved to its open position, lies in the path of balls between the gate and the retrieval compartment so as to prevent the delivery of balls to the compartment until such time as the coin controlled actuating mechanism is returned to its normal, inactive position.

Appropriate means are provided at the inlet end of the trap so as to divert a pocketed cue ball from the path normally taken by pocketed object balls. A second passageway is associated with the cue ball separating means and enables the pocketed cue ball normally to be returned to the retrieval compartment, thereby preventing premature termination of a game by inadvertent pocketing of the cue ball.

The length of the trap is such that, when all object balls have been pocketed and are barred by the gate from entering the retrieval compartment, there is insufficient space between the last-pocketed object ball and the cue ball passageway to enable the cue ball to pass to the retrieval compartment. Accordingly, all the balls, both object and cue, may be retained in positions inaccessible to players until such time as the coin controlled actuating mechanism is operated so as to enable the object balls to move past the gate. Once the object balls begin to move toward the compartment, that object ball blocking the cue ball's movement also will move toward the gate, thereby providing sufficient space to enable the cue ball to proceed along its pathway toward the compartment.

The apparatus preferably is wholly contained within a drawer-like housing which may be slid as a unit into and out of a space formed at one end of the table. Thus, the entire assembly may be removed from the table as a unit for maintenance and servicing when required. If maintenance or servicing of the assembly will require more than a few minutes, the unit requiring attention may be replaced by a different unit, thereby avoiding prolonged disuse of the affected table.

THE DRAWINGS

The presently preferred embodiment of the invention is disclosed in the following description and illustrated in the accompanying drawings, wherein.

Figure 1:
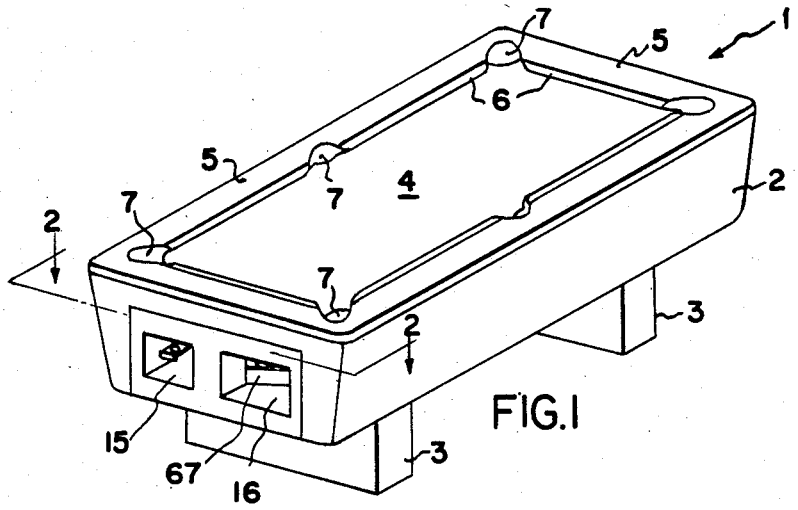
FIG. 1 is an isometric view of a pool table of the kind with which apparatus constructed in accordance with the invention is adapted for use.
Figure 2:
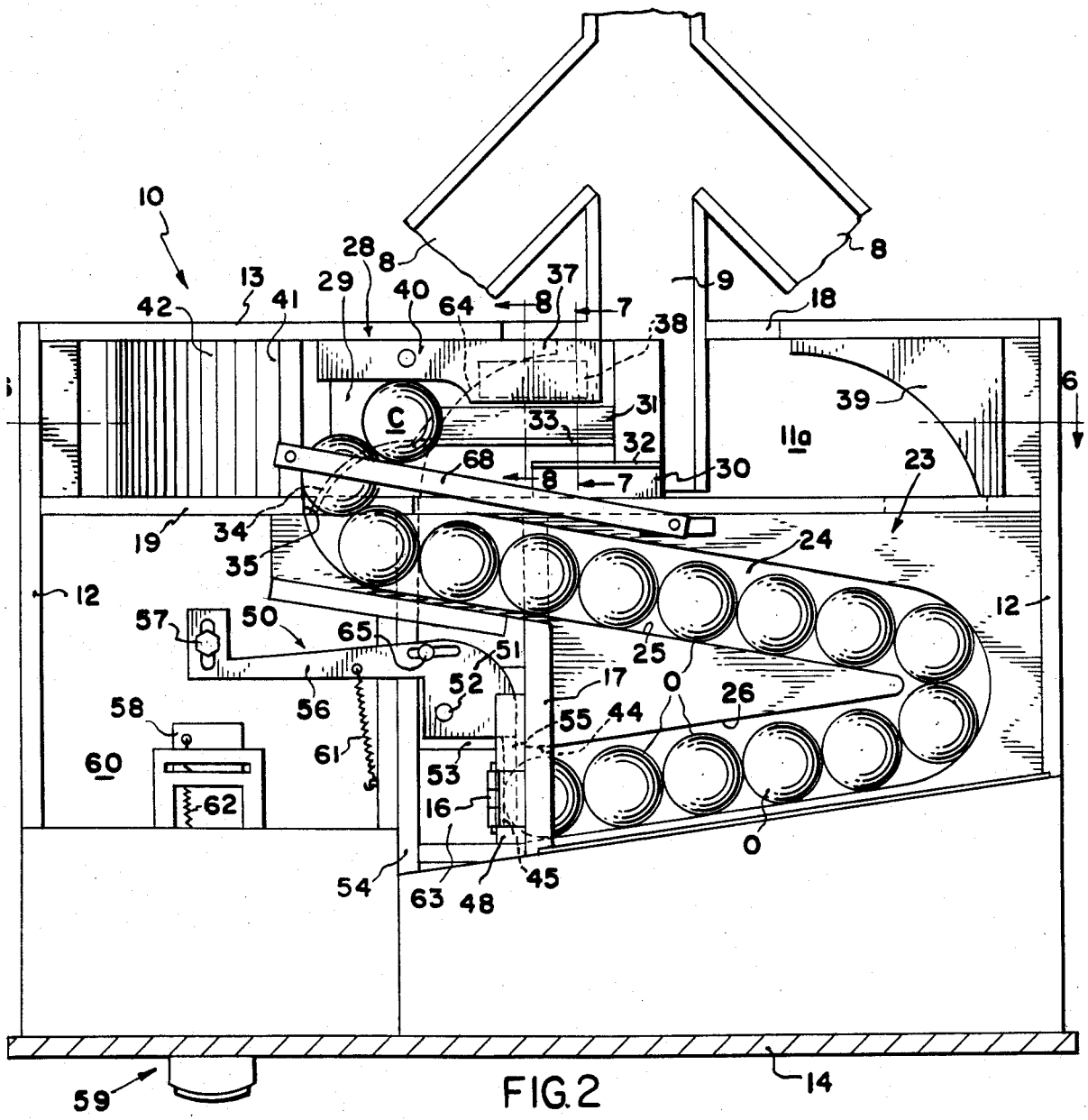
FIG. 2 is a fragmentary, sectional view on a greatly enlarged scale and taken on the line 2—2 of FIG. 1.
Figure 7:
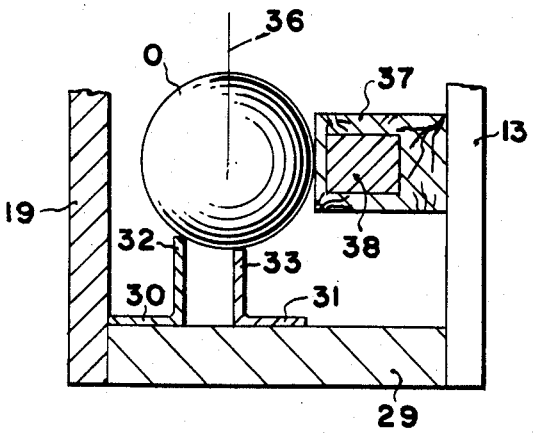
Figure 8:
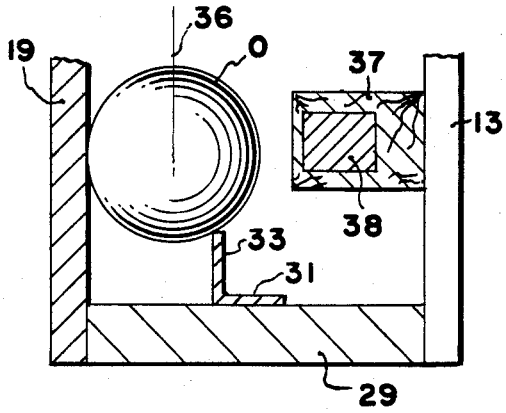

FIGS. 7 and 8 are sectional views taken on the lines 7—7 and 8—8, respectively, of FIG. 2.

DETAILED DESCRIPTION

Apparatus constructed in accordance with the preferred embodiment of the invention is adapted for use with a pool table 1 comprising a frame 2 supported on legs 3 and having a horizontal, rectangular playing surface 4 bounded by rails 5 on which cushions 6 are supported, as is conventional. At each of the four corners of the playing surface is an opening or pocket 7 and a similar pocket 7 is associated with each of the two opposed, longer side rails 5. A complement of fifteen object balls O and one cue ball C are used in conjunction with the table, and each of such balls is of uniform diameter and is capable of being pocketed in any of the openings 7.

Each of the openings 7 has associated therewith a downwardly inclined runway 8 which extends from adjacent the associated opening inwardly toward the center of the table and communicates with a common trough 9 which is downwardly inclined toward one end of the table.

Figure 3:
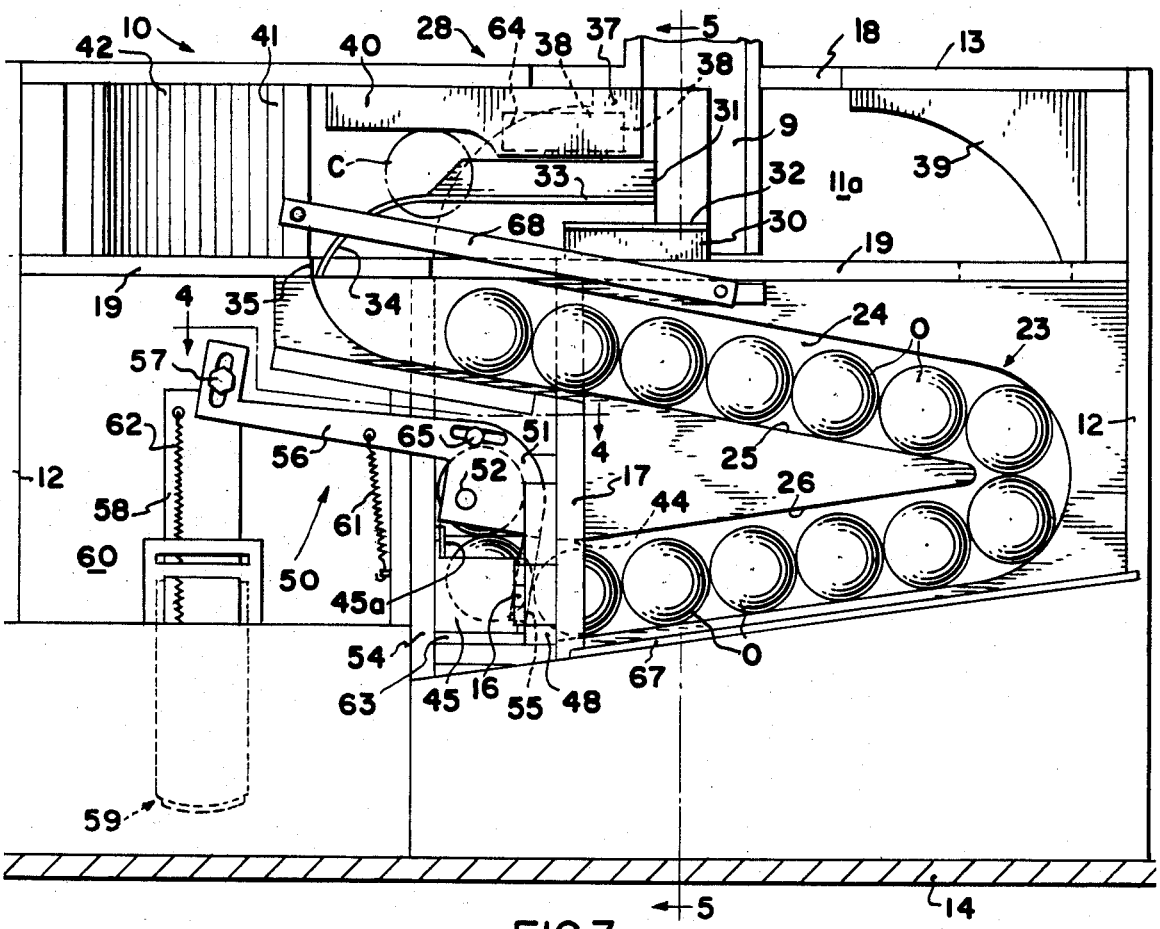
FIG. 3 is a view similar to FIG. 2, but illustrating some of the parts in adjusted positions.

At that end of the table toward which the trough 9 slopes is a space within which is a drawer 10 slideably is accommodated. The drawer comprises a bottom 11 having upstanding, spaced apart side walls 12, a rear wall 13, and a front wall 14. Two side-by-side openings are formed in the front wall 14. One opening leads to a recess 15 adjacent one side wall 12 and the other leads to a compartment 16 accessible via its opening. The recess and the compartment are separated by a partition 17. The purposes of the recess 15 and the compartment 16 will be explained hereinafter. The rear wall 13 is provided with an opening 18 through which the terminal end of the trough 9 may extend, as is shown in FIGS. 2 and 3. In the interest of clarity, the trough end is not shown in FIG. 5.

Between the rear and front walls of the drawer 10 is a pair of vertical partitions 19 and 20 which are spanned by a support 21 that is inclined downwardly toward the front wall 14. See FIG. 5. Mounted on the support 21 is a trap 22 comprising a preferably molded, unitary body 23 having an upwardly open groove or pathway 24 formed therein. The pathway has two segments 25 and 26. As is best shown in FIG. 3, the pathway segment 25 is inclined downwardly to the right, and the pathway segment 26 is inclined downwardly to the left. These inclinations, coupled with the forward pitch of the support 21, enable the pathway to be sufficiently inclined to ensure downward movement of the object balls along the pathway.

Interposed between the ball delivery trough 9 and the upper or inlet end of the trap pathway 24 is transfer means designated generally by the reference character 28 for directing object balls O into the pathway 24 and for diverting the cue ball C from the pathway 24 to another pathway. The transfer device is of known construction and comprises a base 29 (FIGS. 5 and 6) on which are supported two angular members 30 and 31, the member 30 having an upstanding rail 32 and the member 30 having a similar upstanding rail 33. The rail 32 has a greater height than that of the rail 33, but the latter is longer in length and has a curved end 34 (FIGS. 2 and 3) which projects into an opening 35 formed in the partition 19 adjacent the upper end of the ball pathway 24.

The support 29 is inclined downwardly and to the left as viewed in FIGS. 2 and 3 (i.e., in a direction toward the opening 35) so that any ball delivered by the trough will roll by gravity from the trough onto the transfer device 28 and thence across the latter in the direction of the opening 35.

Any ball, object or cue, approaching the transfer device 28 will rest partly upon the rail 32 and partly upon the rail 33 as is shown in FIG. 7. The rail 32 is offset to one side of a vertical plane 36 passing diametrally through the ball. Since the rail 32 is higher than the rail 33, a ball occupying the position shown in FIG. 7 is caused to lean against a wood block 37 mounted on the rear wall 13 of the drawer and within which is embedded a magnet 38. The length of the rail 32 is such that it terminates at a point opposite the magnet 38. Therefore, the support for the ball provided by the rail 32 terminates as the ball rolls across the transfer device in the direction of the opening 35. Since the rail 33 is offset toward one side of the diametral plane 36 of the ball, movement beyond the rail 32 of a ball containing no magnetically permeable material will cause the ball to lean toward and engage the partition 19 as it rolls toward the opening 35. As the ball approaches the opening 35, the curved end 34 of the rail 33 will guide the ball into the opening 35 as is best indicated in FIG. 2. It is contemplated that the object balls will contain no magnetically permeable material.

The cue ball C may include magnetically permeable material of known kind so as to enable the ball to be attracted by the magnet 38 as it rolls along the two rails 32 and 33. The magnet 38 is of such strength as to retain the cue ball C against the block 37, even following movement of the ball beyond the rail 32. The block 37 has a reduced end 40 adjacent the end of the magnet 38 so as to enable the diametral plane 36 of the cue ball to move to the opposite side of the rail 33, as is shown in FIGS. 2 and 3, until such time as the cue ball reaches the end of the support 29. The ball C then falls through an opening 41 (FIGS. 2 and 3) between the rear wall 13 and the partition 19 onto a deflector 42 and is received on one end of a transversely and downwardly inclined ramp 11*a* (FIG. 6) between the rear wall 13 and the partition 19 and forming a part of the bottom 11. At the other end of the ramp 11*a* there is an opening 43 in the partition 19 which leads via a guide 39 into the compartment 16.

Object balls O introduced to the upper end of the pathway 24 roll downwardly along the latter toward an opening 44 formed in the partition 17. See FIG. 2. A gate 45 formed of magnetically permeable material normally lies athwart the path of movement of the balls at the opening 44 and closes the latter. The gate is pivoted at its upper end by means of a hinge 46 for swinging movements between positions in which the opening 44 is closed and opened.

Mounted on the partition 17 below the opening 44 is a permanent magnet 47. The hinge 46 is mounted on a block 48 fixed to the partition 17 in such position that the gate 45 constantly is urged by gravity to a position in which its lower end is sufficiently close to the magnet 47 as to enable the latter to attract the gate. The gate has an extension 45*a* at its lower end the purpose of which will be explained shortly.

The strength of the magnet 47 is such that it is capable of releasably latching the gate 45 in its closed position notwithstanding the facts that an object ball rolling down the inclined pathway 24 has momentum and that as many as fifteen object balls may occupy the pathway 24 at one time.

Figure 4:
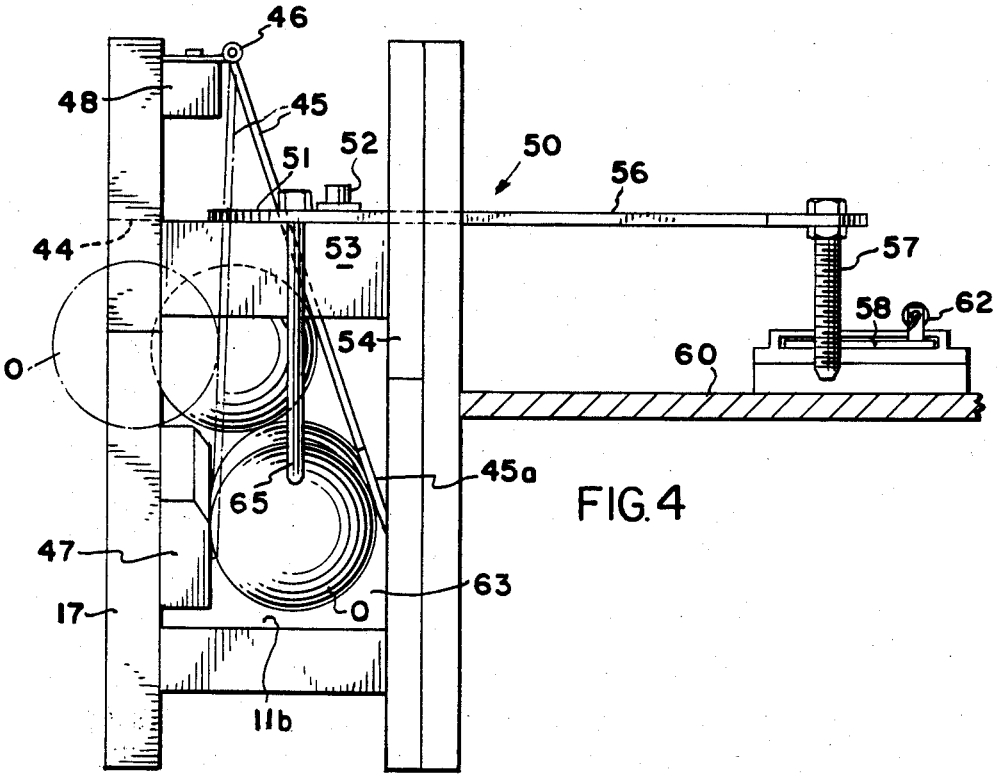
FIG. 4 is a sectional view, on an enlarged scale, and taken on the line 4—4 of FIG. 3.

Operating means 50 is provided to move the gate 45 from its closed position to its open position. The operating means comprises a crank 51 pivoted at 52 on a support 53 spanning the distance between the partition 17 and a spaced, parallel partition 54 (see FIG. 4). The crank has one arm 55 (best shown in FIG. 3) which lies between the partition 17 and the upper end of the gate 45. The crank 50 has a second arm 56 at the free end of which is a pin 57 that lies in the path of movement of a reciprocable slide 58 forming part of a coin controlled mechanism 59 of known construction and mounted on a shelf 60 spanning the partition 54 and the adjacent side wall 12. The slide is accessible via the recess 15. A spring 61 constantly biases the crank 50 to the position shown in FIG. 2 and another spring 62 constantly biases the slide 58 to the position shown in FIG. 2.

To condition the apparatus for operation the object balls O and the cue ball C are placed on the playing surface 4 of the table 1 and the playing of a game commenced. The cue ball is used by one or more players to pocket the object balls.

As each object ball O is pocketed it moves down the associated runway 8 to the trough 9 and enters the drawer unit 10 via the opening 18 in the rear wall 13. The object ball rolls by gravity off the trough 9 onto the transfer device 28 and, since the object ball includes no magnetically permeable material, it will be guided by the curved rail portion 34 through the opening 35 in the partition 19 and into the inlet end of the segment 25 of the pathway 24. Such object ball will roll down the pathway 24 until it engages the gate 45 which closes the opening 44 in the partition 17. Object balls O which subsequently are pocketed will follow the same route and come to rest against the first object ball and each subsequently pocketed ball as is indicated in FIGS. 2 and 3.

When the game is over and the players wish to play another, one or more coins may be inserted in the slide 58 of the coin controlled mechanism 59 so as to enable the slide to be slid from the position shown in FIG. 2 to the position shown in FIG. 3. As the slide 58 moves, it engages the pin 57 and rocks the crank 51 clockwise as shown in FIG. 2 about the axis of the pivot 52. Such movement of the crank 51 causes the crank arm 55 to swing the gate 45 from its closed position to its open position shown in FIG. 4. Following movement of the gate to its open position, all of the object balls O on the pathway 24 will roll downwardly, by gravity, and pass in succession through the opening 44 in the partition 17.

Figure 5:
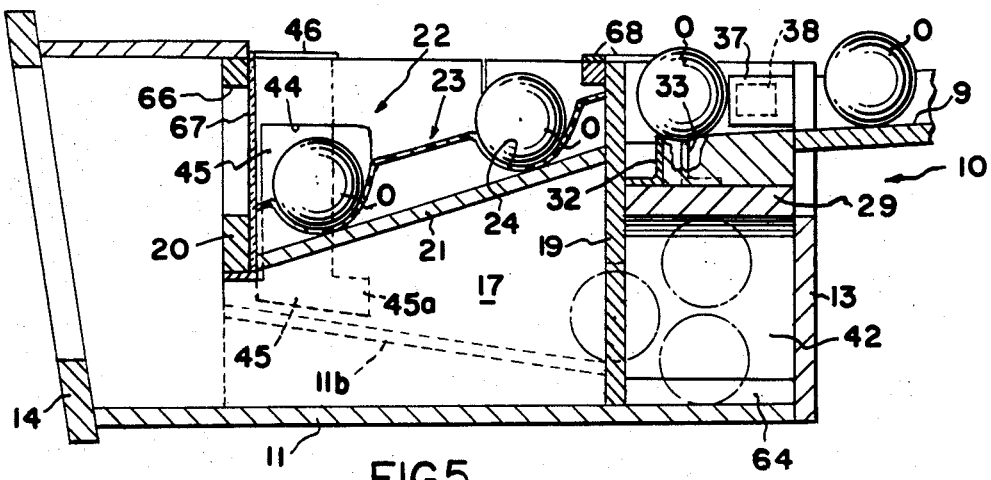
FIG. 5 is a sectional view taken on the line 5—5 of FIG. 3.
Figure 6:
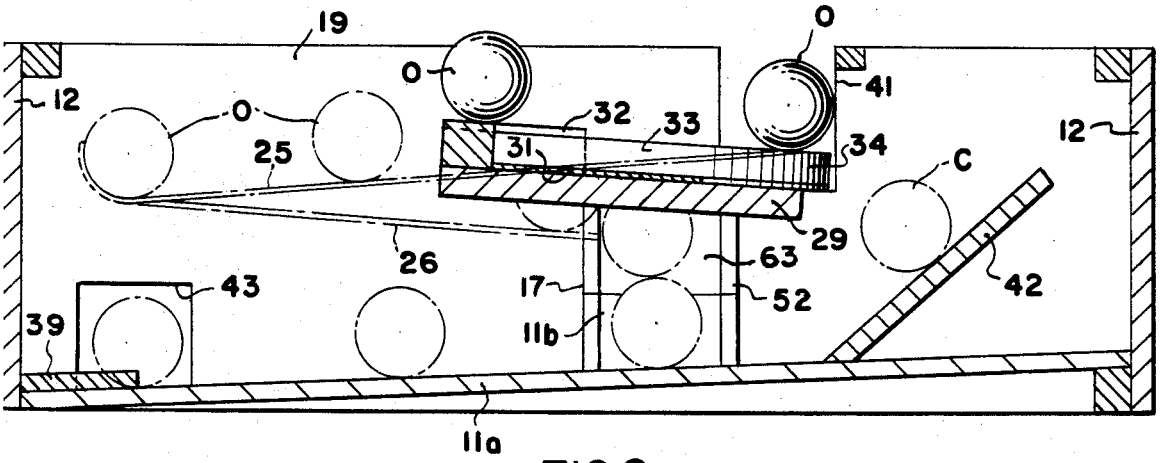
FIG. 6 is a sectional view taken on the line 6—6 of FIG. 2.

A channel 63 for such balls is provided between the partitions 17 and 52 and has a rearwardly and downwardly inclined ramp 11*b* forming part of the bottom of the drawer unit 10 (see particularly FIG. 5). The ramp 11*b* of the channel 63 merges with the ramp 11*a* between the ends of the latter. Balls exiting the channel 63, therefore, are delivered by gravity to the ramp 11*a* and are guided onto the latter by a guide 64. From the ramp 11*a* the object balls will pass into the compartment 16, following the same route as the cue ball.

As long as the gate 45 remains in its open position, any ball introduced to the pathway 24 will pass through the opening 44 and be received in the compartment 16. To prevent the gate's being maintained in its open position by securing the slide 58 of the coin control mechanism 59 in the actuated position shown in FIG. 3, the crank 51 has secured thereto a downwardly extending stop pin or finger 65 which moves with the crank. The finger 65 is so positioned with respect to the crank arm 55 that, when the latter moves and opens the gate 44, the finger 65 will lie in the path of the leading object ball (FIG. 3) that has passed through the opening 44, thereby preventing any of the object balls from traversing the channel 63 and entering the compartment 16 until such time as the finger is removed from the path of movement of the balls.

To remove the finger 65 from the path of movement of the object balls, the slide 58 must be returned to its inactive position. Such movement of the slide will cause the crank arm 55 to disengage the gate 45. The gate nevertheless will remain in its open position, however, inasmuch as an object ball resting upon the channel ramp 11*b* bears against the lower, free end of the gate and prevents the latter from rocking toward the magnet 47. The gate extension 45*a* ensures retention of the gate in its open position as each successive ball traverses the channel and during the time it takes for a succeeding ball to enter the channel.

Once the last ball on the pathway 24 has left the latter and traversed the channel ramp 11*b*, the gate 45 will swing by gravity toward its closed position, thereby enabling the magnet 47 once again to latch the gate in its closed position. Thereafter, additional object balls introduced to the pathway 24 will remain on the latter until such time as the gate 45 once again is opened by the crank.

In the preferred embodiment the partition 20 at the forward end of the trap 22 has an opening 66 (FIG. 5) closed by a transparent window 67. Such window enables a player to view the object balls on the pathway segment 26 to determine the order in which order such balls were pocketed.

In the event the cue ball C is pocketed prior to the end of the game, the transfer device 28 will divert the cue ball from the path taken by the object balls O to the path defined by the rail 33 and the block 37 as described previously.

A desirable feature of apparatus constructed in accordance with the invention is that the length of the pathway 24 from its inlet the gate 45 is such that, when all fifteen object balls have been pocketed and are supported on the trap 22, there is insufficient room between the last pocketed object ball and the block 37 to permit passage of the cue ball C beyond the transfer device 28.

See FIG. 2. Thus, when all of the object balls have been pocketed, the cue ball also may be pocketed, thereby storing all of the balls in readiness for use once the coin controlled mechanism 59 is actuated. The ability of the cue ball to be stored along with the object balls minimizes greatly the likelihood of misuse or theft of the cue ball.

It is not necessary that the cue ball C contain magnetically permeable material. If desired, the magnetic cue ball may be replaced by a non-magnetic cue ball having a diameter larger than that of the object balls. In this event a guide arm 68 (FIGS. 2 and 3) may overlie the transfer device at a level such as to be engaged by the cue ball, but not by an object ball. Engagement of the arm 68 by the cue ball will cause the latter to be diverted from the pathway 24. Again, if all of the object balls are supported on the trap, the oversize cue ball will be unable to pass the uppermost object ball, and thus cannot reach the compartment 16.

The drawer unit 10 is a fully integrated assembly and is removable from the table as a unit. Any drawer unit is exchangeable with any other unit, thereby enabling a unit requiring repair or maintenance to be replaced by another unit with substantially no loss of playing time. It will be understood that suitable locking means (not shown) will be included as part of the apparatus so as to preclude therewith.

The disclosed embodiment is representative of a presently preferred form of the invention, but is intended to be illustrative rather than definitive thereof. The invention is defined in the claims.

We claim:

1. Ball control apparatus for selectively disabling and enabling delivery of one or more balls to a compartment, said apparatus comprising means forming a ball-supporting pathway leading to said compartment; a gate; means mounting said gate for movements between first and second positions in which said gate respectively prevents and permits passage of a ball from said pathway to said compartment; magnetic means operable to exert a magnetic latching force on said gate and releasably retain the latter in said first position; and operating means movable from an inactive position to an active position in which said operating means exerts on said gate a force of such magnitude as to overcome said magnetic force and move said gate to its second position.

2. Apparatus according to claim 1 including stop means carried by said operating means and operable in response to movement of said operating means to its active position to move said stop means into the path of movement of balls from said gate toward said compartment.

3. Apparatus according to claim 2 wherein said stop means is out of said path of movement when said operating means is in its inactive position.

4. Apparatus according to claim 1 including means biasing said operating means to its inactive position.

5. Apparatus according to claim 1 wherein the magnetic force exerted on said gate when the latter is in its second position is insufficient to restore said gate to its first position.

6. Apparatus according to claim 1 wherein said gate is rockable between said first and second positions.

7. Apparatus according to claim 6 wherein said gate when in its second position is biased by gravity toward its first position.

8. Apparatus according to claim 1 including means forming a second pathway branching off the first mentioned pathway, and means for diverting one ball from the first mentioned pathway to said second pathway.

9. Apparatus according to claim 8 wherein the diverting means is magnetic.

10. Apparatus according to claim 8 wherein said one ball has a diameter greater than that of any other of said balls, and wherein said diverting means comprises a guide engageable only with said one ball.

11. Apparatus according to claim 8 wherein the distance between said gate and said diverting means is such that the presence of a selected number of balls on the first mentioned pathway effects blocking of said second pathway.

12. Apparatus for selectively enabling and disabling delivery of a complement of balls to a single compartment, said apparatus comprising means forming a pathway leading to said compartment; a gate athwart said pathway upstream from said compartment and past which gate each ball admitted to said compartment must move; means mounting said gate for movements between a first position in which said gate obstructs said pathway and disables said balls from entering said compartment and a second position in which each of said balls is engageable with but may pass said gate and enter said compartment, said gate when in said second position being biased gravitationally to return to said first position; latch means for releasably latching said gate in said first position; movable operating means; and means for moving said operating means in a direction to release said latch means and move said gate from said first position to said second position, movement of said balls along said pathway following movement of said gate to said second position causing each of such balls successively to engage said gate and prevent return of said gate in said first position until all balls on said pathway have moved past said gate.

13. Apparatus according to claim 12 wherein said pathway is inclined downwardly toward said compartment, thereby enabling said balls to move by gravity toward said compartment.

14. Apparatus according to claim 12 including stop means carried by said operating means and movable therewith into and out of a ball-engaging position between said gate and said compartment.

15. Apparatus according to claim 12 including means forming a second pathway branching off the first mentioned pathway upstream from said gate, and diverting means for diverting a selected ball from the first mentioned pathway to said second pathway.

16. Apparatus according to claim 15 wherein the diverting means is magnetic.

17. Apparatus according to claim 15 wherein said one ball has a diameter greater than that of any other of said balls, and wherein said diverting means comprises a guide engageable only with said one ball.

18. Apparatus according to claim 15 wherein the distance between said gate and said diverting means is such that the presence of a selected number of balls on the first mentioned pathway effects blocking of said second pathway.

19. Apparatus according to claim 12 wherein said gate is magnetically permeable and said latch comprises a magnet.

* * * * *